US005180423A

United States Patent [19]

Marcuson et al.

[11] Patent Number: 5,180,423

[45] Date of Patent: Jan. 19, 1993

[54] CONVERTER AND METHOD FOR TOP BLOWING NONFERROUS METAL

[75] Inventors: Samuel W. Marcuson, Sudbury; Carlos A. Landolt, Lively; James H. Amson, Sudbury; Haydn Davies, Fonthill, all of Canada

[73] Assignee: INCO Limited, Toronto, Canada

[21] Appl. No.: 845,642

[22] Filed: Mar. 4, 1992

[30] Foreign Application Priority Data

Apr. 26, 1991 [CA] Canada ..... 2041297

[51] Int. Cl.[5] ..... C21C 5/34

[52] U.S. Cl. ..... 75/649; 75/643; 266/173

[58] Field of Search ..... 75/643, 649; 266/173

[56] References Cited

U.S. PATENT DOCUMENTS

| | | | |
|---|---|---|---|
| 4,435,211 | 3/1984 | Schwartz | 75/649 |
| 4,469,513 | 9/1984 | Staib | 75/76 |
| 4,614,542 | 9/1986 | Kimura | 75/643 |
| 4,783,219 | 11/1988 | Mori | 75/623 |
| 4,830,667 | 5/1989 | Marcuson et al. | 75/76 |

FOREIGN PATENT DOCUMENTS

| | | |
|---|---|---|
| 1008561 | 4/1977 | Canada . |
| 1035575 | 8/1978 | Canada . |
| 1042207 | 11/1978 | Canada . |
| 1234292 | 3/1988 | Canada . |

OTHER PUBLICATIONS

Diaz et al.-"Conversion of Nickel and Sulfuric-Containing to Blister"-Copper 87, vol. 4-Pyrometallurgy of Copper Apr., 1988, pp. 294-304.

*Primary Examiner*—Peter D. Rosenberg

*Attorney, Agent, or Firm*—Blake T. Biederman; Edward A. Steen

[57] ABSTRACT

The invention provides a converter for purifying molten nonferrous material. A converter body having a refractory lined chamber holds the nonferrous material. A gas injector means pierces a lower portion of the chamber for bottom sparging the nonferrous material. A lance pierces an upper portion of the converter body projecting minimally into the chamber for limited exposure to adverse conditions. While converting with top blowing of gas containing oxygen and bottom stirring solid nonferrous metal may be added to the converter to cool the molten nonferrous material and purified molten nonferrous metal.

18 Claims, 1 Drawing Sheet

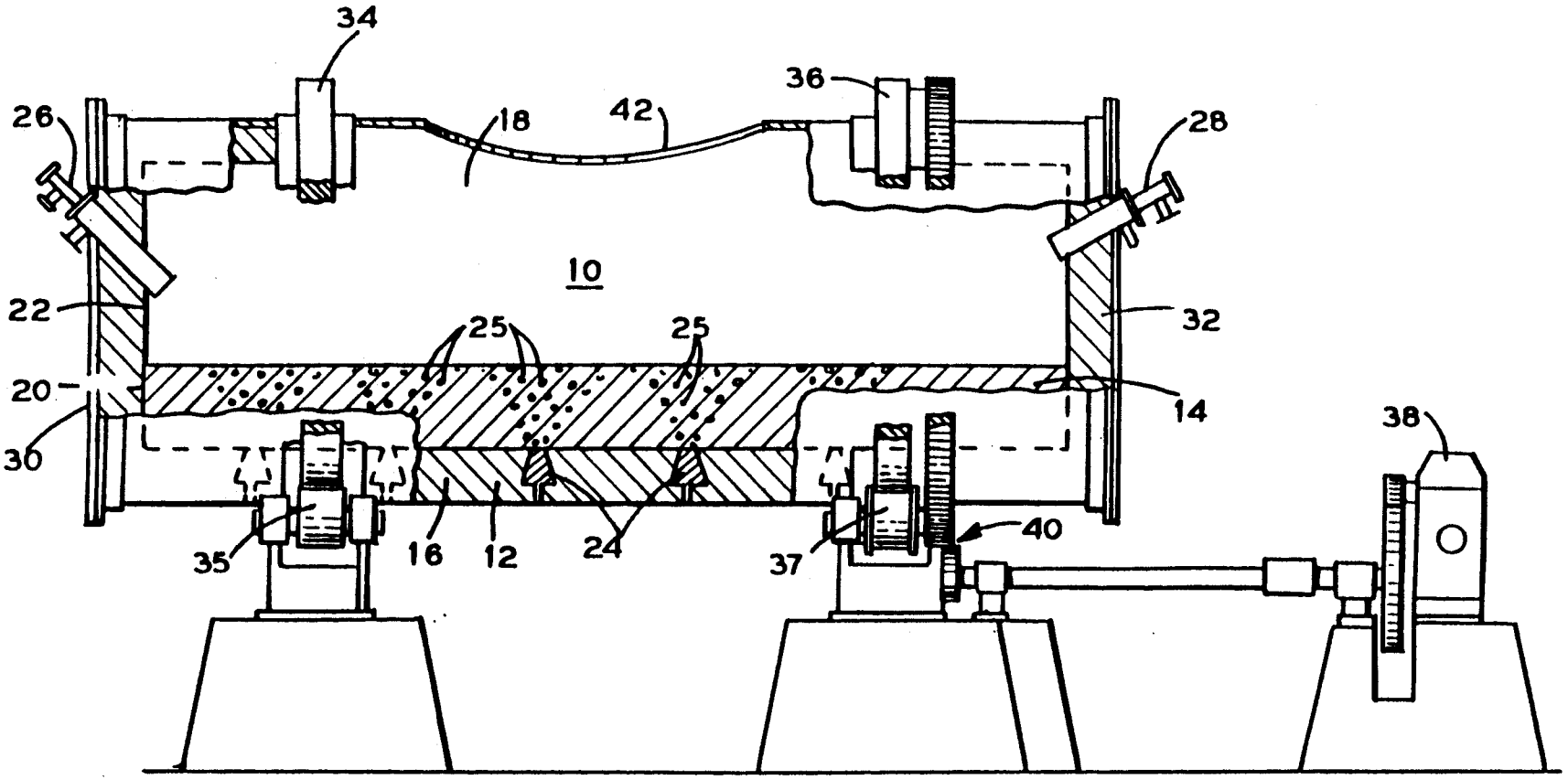
38
28
32
14
40
36
37
42
25
24
10
18
25
12
16
34
35
26
22
20
30

CONVERTER AND METHOD FOR TOP BLOWING NONFERROUS METAL

TECHNICAL FIELD

This invention relates to converter furnaces for purifying nonferrous material. In particular, this invention relates to a lance design for a converter furnace which employs top blowing with gas containing oxygen in combination with bottom sparging. In addition, this invention relates to a method for high oxygen efficiency purification of nonferrous materials.

BACKGROUND OF THE INVENTION

An improved copper converting process of top blowing with gas containing oxygen in combination with bottom sparging was disclosed by Marcuson et al. in U.S. Pat. No. 4,830,667. In Marcuson et al., a molten copper sulfide bath was top blown with oxygen to form free Cu and $SO_2$ gas. The molten bath was simultaneously sparged to improve oxygen efficiency and decrease amount of copper oxide formed in relation to amount of nickel oxide formed. The process of one '667 patent has achieved levels of high oxygen efficiency with relatively short cycle times causing a tendency to overheat nonferrous metal. Overheating of nonferrous metal is undesirable because it tends to substantially reduce refractory life and product quality.

Conventionally, lance designs have been both relatively complex and relatively expensive to maintain. Lances have penetrated the hot zone of a furnace to a position above or submerged in molten copper. Several lance designs require extensive cooling to limit oxidation or melting of the lance. Cooling has generally been accomplished by water cooling or gas shrouding. An example of a water cooled lance was provided by H. Smeikal in Canadian Patent No. 1,008,661. Smeikal disclosed a lance having increased cooling passage cross-section in regions exposed to the greatest amount of heat. Kimura et al. in Sumitomo's Canadian Patent No. 1,234,292, illustrated a conventional converter lance arrangement in which high pressure (1 to 3 $kg/cm^2$) oxygen was blown vertically at a molten bath in combination with forcing air through tuyeres. In Sumitomo's patent the height of the lance was maintained within 0.4 m of the molten bath to ensure a high oxygen velocity at impact.

A water cooled lance having a design feature to prevent clogging from splashing of molten metal, matte or slag was disclosed by L. Jaquay in Canadian Patent No. 1,042,207. Another lance system for "simplified" maintenance was disclosed by Suglura et al. of Mitsubishi in Canadian Patent No. 1,035,575. Suglura et al. disclosed a lance vertically adjusted for simplified lance replacement and height adjustment. Mitsubishi lances are disposable pipes which are non-water cooled; and they have to be replaced at a relatively rapid rate. Additionally, Mitsubishi lances are continually rotated to promote even wear. Several relatively complicated lance designs, ideas, systems and procedures have been suggested for providing a lance having improved reliability, operability and efficiency.

It is an object of this invention to provide a quick, efficient method of purifying nonferrous materials by reaction with oxygen.

It is a further object of this invention to provide a converter means including a lance which limits splashing of molten materials which can clog lances and accelerate refractory erosion.

SUMMARY OF THE INVENTION

The invention provides a converter for purifying molten nonferrous material. A converter body having a refractory lined chamber holds the nonferrous material. A gas injector means pierces a lower portion of the chamber for bottom sparging the nonferrous material. A lance pierces an upper portion of the converter body projecting minimally into the chamber for limited exposure to adverse conditions. While converting with top blowing of gas containing oxygen and bottom stirring solid nonferrous metal such as scrap may be added to the converter to cool the molten nonferrous material and purified molten nonferrous metal.

BRIEF DESCRIPTION OF DRAWING

The FIGURE is a schematic of a converter furnace having a side wall broken away and having a lance piercing each end of the walls of a converter furnace.

DESCRIPTION OF PREFERRED EMBODIMENT

For purposes of this specification, nonferrous defines copper and nickel metals; copper and nickel oxides; copper and nickel sulfides; copper and nickel-iron alloys; melts containing precious metals; and other impurities amenable to oxidation by free oxygen common to copper, nickel and precious metal refining; and incidental impurities. Efficiency, for purposes of this specification, defines the amount of oxygen combining with molten nonferrous material divided by the total amount of oxygen supplied to the converter. All ingredient percentages indicate percent by weight unless specifically expressed otherwise. A "modified Peirce-Smith" converter means a horizontally mounted, rotatable barrel shaped, refractory lined vessel in which tuyeres characteristic of the Peirce-Smith converter have been removed or rendered temporarily or permanently inoperable. "Oxide mush" as used in this specification and claims means solid or semi-molten metal oxide product of oxidation e.g. nickel oxide in which copper or copper oxide is entrained.

The method of the invention is useful for purifying nonferrous materials by preferentially oxidizing impurities which may be readily removed as a slag or as a gas leaving a purified nonferrous metal. The method of the invention is most advantageously useful for converting nonferrous metal sulfides. Advantageously, $Cu_2S$, $Ni_3S_2$ and other partially converted sulfides such as semi-blister copper (1–8 wt % sulfur) may be converted. In addition, the method facilitates recycling of scrap metal.

Referring to the FIGURE, a modified Peirce-Smith converter 10, not having tuyeres, was provided for oxidizing molten nonferrous sulfide by top blowing with an oxidizing gas and bottom sparging. However, optionally tuyeres may be present. Bottom sparging is accomplished using an inert or reducing gas. Preferably, nitrogen gas which is inert to molten nonferrous metal is used. A converter body 12 was used for smelting or converting molten nonferrous material e.g. nonferrous sulfide 14. Converter body 12 has refractory 16 lining chamber 18. Refractory 16 is preferably constructed of materials known in the art such as various refractory bricks. Chamber 18 is divided into a lower portion 20 for holding nonferrous material 14 and an upper portion 22 above said lower portion. Porous plugs 24, permeable to gas but essentially impermeable to molten material, operate as gas injector means for bottom sparging molten nonferrous material 14 by forming bubbles 25 which rise to the surface of molten nonferrous material 14. Most advantageously, positioning of porous plugs 24 allows for turning of converter body 12 such that porous plugs 24 are raised above nonferrous material 14 without pouring nonferrous material 14. This raising of porous plugs 24 above nonferrous material 14 provides emergency protection in the event of a leak through or around porous plugs 24. A pair of lances 26 and 28 pierce upper portion 22 of converter body 12. Lances 26 and 28 were connected to a source of gas containing oxygen (not shown in FIG. 1). The oxygen source may be air and preferably, is oxygen enriched air or substantially pure oxygen. For purposes of this specification, substantially pure oxygen is oxygen that is at least 85% oxygen. Most preferably, substantially pure oxygen is used for effective nonferrous metal conversion, since greater oxygen concentrations provide for increased scrap melting capability.

Lances 26 and 28 are aligned to direct oxygen-containing gas to areas of molten nonferrous material surface which are stirred by rising sparging gas. Sparging continually produces a fresh or new surface for effective oxidation of impurities contained in nonferrous materials. Lances 26 and 28, angled from a horizontal centerline position, direct oxygen downwardly toward this fresh surface. Oxygen efficiencies of 75% are readily obtainable with the process of the invention without the need for use of high velocity jetting of gas into another material. In some stages of copper conversion efficiencies of 90% and greater may have been achieved. These high oxygen use efficiencies in combination with mixing from the bottom sparging provide effective heating of the molten bath. Overheating of the molten bath is what shortens the effective life of converter refractory. Most preferably, substantially pure nonferrous metal scrap as required is added to prevent overheating. Pieces of metal large enough to sink through a top layer of stiff oxide mush are preferably used. In addition, it is preferred that pieces of metal requiring long melting times be placed in the furnace at the beginning of the oxygen blowing cycle.

Lances 26 and 28 are located outside of the highest temperature region of the furnace in an upper portion of end walls 30 and 32. Lances 26 and 28 project minimally into the chamber 18 for limiting exposure to harsh conditions which decrease lance life. Minimally exposed is defined as placing a lance in a location spaced from the molten material such that molten material splashes minimally into the lance. Advantageously, the lance is positioned in a location having a temperature at least 25% cooler than the temperature of the molten material in degrees K (when a supplemental burner is not being used). Advantageously, lances protrude less than 1 m into a converter and most advantageously protrude into a converter less than 10 cm. Optionally, a simple water cooling jacket may be added for additional heat protection. This distal placement of the lances provides an efficient, low cost, low maintenance converter for processing nonferrous materials. Converter 10 is preferably of a modified Peirce-Smith design which does not require tuyeres. With Peirce-Smith designs rings 34 and 36 are supported by rollers 35 and 37. Motor 38 operates driving mechanism 40. Driving mechanism 40 turns converter body 12 by riding rings 34 and 36 on rollers 35 and 37. To empty chamber 18 of converted (substantially reduced level of impurity) nonferrous material, body 12 is rotated until molten nonferrous metal flows from mouth 42. Porous plugs 24 typically erode with refractory 16 and periodically fail. For this reason, porous plugs 24 are preferably positioned in a location laterally spaced from driving mechanism 40 and molten material 14 in the converter are limited in volume such that by rotation porous plugs 24 can be raised above the level of molten material 14 without discharge of molten material 14.

EXAMPLE

Testwork was conducted using a tuyere-less modified Peirce-Smith converter equipped with two oxygen lances mounted on the endwalls. A removable air-fuel burner maintained heat during idle periods and five bottom mounted porous plugs stirred melts providing a bubbling surface. The two oxygen lances (east and west) were mounted at opposing end walls of the converter for minimal exposure to the converter temperatures and atmosphere (See FIG. 1). Each oxygen lance was cooled with a water jacket and also had gas lines extending through the water jackets in order to provide service as a burner. The west lance was angled at approximately 45 degrees downward along the centerline of the converter to direct oxygen at the bubbling area below. The east lance, similarly mounted, was directed at a 25 degree angle. An air-natural gas burner could be mounted in the east end for providing supplemental heat. Externally fired burners or fuel addition to the lances may be employed to provide startup heat or for recycling additional scrap. During actual conversion operations, external fuel addition was not required. Due to the low splashing design of the invention, burners and oxygen lances may be operated simultaneously. In addition, bottom stirring may be used in combination with burners to hold molten metal, matte or slag indefinitely. Bottom stirring circulates the molten material for even heating which prevents the lower most metal from freezing. Nitrogen gas was sparged through the porous plugs for stirring molten semi-blister copper. Plugs used in each position were Narco A94 fused alumina nondirectional plugs. Each porous plug operated at about $3.8\times10^{-3}$ std. $m^3$/sec. Each of these porous plugs was capable of maintaining a surface area of 0.9–1.2 m diameter free of mush throughout a converter cycle.

Equipment capability of the converter is below in Table 1:

TABLE 1

| | East Oxygen Lance | West Oxygen Lance |
|---|---|---|
| Natural Gas Flow (std. $m^3$/s) | 0.14 | 0.09 |
| Oxygen Flow (metric ton/day) | 127 | 84 |
| Gas Velocity as calculated at lance tip (m/s) | 209 | 139 |
| Distance to Bath (m-estimated) | 3.5 | 1.7 |

A total of 15 experimental semi-blister finishing tests were undertaken. Typically, heats of approximately 120 metric tons of semi-blister (about 3% sulfur) were converted to blister copper using top blowing with simultaneous bottom stirring. Oxygen lances (15.2 cm diameter) were equipped with a 7.0 cm diameter concentrically installed insert to increase gas velocity. At blowing rates of 84–91 metric tons per day per lance, oxygen gas velocity ranged from 139 to 150 m/s. (All gas velocities were calculated at the lance tip assuming a 1 atmosphere pressure at standard temperature.) The targeted converter temperature was 1260° to 1290° C. Clean copper anodes were used to cool the converter when temperatures exceeded 1315° C. Large ingots and ladle skulls were also used for cooling. These ingots and skulls generally required two hours of immersion time to completely melt. An oxygen probe was used to determine whether conversion was complete. When conversion was complete, a sufficient quantity of clean copper scrap anodes were added to cool the bath to a temperature below about 1215° C., preferably to a temperature of 1190°–1204° C. This decrease in temperature may increase efficiency of sulfur removal when nitrogen gas is used to agitate the bath and purge additional sulfur from the molten material. However, agitation with nitrogen stirring over the temperature range of 1150° to 1315° C. was effective in reducing sulfur levels. An additional one hour of agitation with nitrogen was then used to lower sulfur content further. Accumulated mush was periodically removed as required. Cleaning of mush after every second cycle is preferred to decrease accumulation which tends to cause excessive splashing at the west lance during and after a second cycle. With the above setup, semi-blister copper was successfully converted to blister copper. Solid copper plates, ingots and ladle skulls were used to cool the converter. A summary of 15 tests is given below in Table 2.

TABLE 2

| | | Metric Tons | Metric Tons | | Distribution % | |
|---|---|---|---|---|---|---|
| | | | Cu | Ni | Cu | Ni |
| In- | Semi-blister | 2032 | 1809 | 98 | 86 | 96 |
| put | Cu anodes | 297 | 297 | | 14 | |
| | Cu ingots | 34 | 9 | 4 | | 4 |
| | Ladle skulls | 14 | 10 | | | |
| Out- | Blister copper | | 1789 | 14 | 84 | 13 |
| put | Washout material | | 333 | 89 | 16 | 87 |

Coolant or scrap addition rate as a function of oxygen blowing rate including tests with one lance and two lances is given below in Table 3.

TABLE 3

| | Oxygen Blowing Rate (metric tons/day) 84–91 | Oxygen Blowing Rate (metric tons/day) 175 | Average for Test |
|---|---|---|---|
| Blowing Cycle (metric tons/charge) | | | |
| Clean Cu scrap | 7 | 21 | 12 |
| Cu ingots | 3.3 | 1.1 | 2.7 |
| Cu ladle skulls | 1.0 | 0.9 | 0.9 |
| Temperature (°C.) at end of blow | | | 1308 |
| Cooling and Agitation | | | |
| Clean Cu Scrap (metric tons/charge) | 8 | 10 | 9 |
| Temperature (°C.) at end of cool | | | 1197 |
| Casting Temperature | | | 1191 |
| Gas Purging Rate (5 plugs each @ $3.8 \times 10^{-3}$ std. $m^3/s$) (metric tons/day) | | | 1.9 |

Overall efficiency of copper reporting to blister was reported as 84 percent. In addition, 87 percent of nickel input reported as 3.8:1 Cu:Ni ratio mush. The previous tuyere method of producing blister copper produced a final sulfur content of 130–150 ppm. Final blister copper produced with the above process after agitation averaged 67+/−29 ppm sulfur and 0.76+/−0.15% nickel.

Quantities of oxygen blown were measured with each test. Oxygen purity was assumed to be 96%. Difficulties were periodically encountered in sampling semi-blister copper, thus test average assays were used when required. East and west lances were tested individually and in combination. Average oxygen efficiencies were 58% for the east lance (25°) at 91 tonnes per day, 80+/−6% for the west lance (45°) and 84+/−9% for the east and west lances in combination. In the absence of a simple accurate method, the above oxygen efficiency values were determined using estimated tonnage of material in and out of the converter and in many cases assays were estimated.

Time required during experimentation to finish conversion of copper containing about 3% sulfur compared to tuyere type finishing which is unable to melt scrap is given below in Table 4:

TABLE 4

| | Lance Type | Lance Type | Tuyere Type |
|---|---|---|---|
| Oxygen Blowing Rate (metric tons/day) | 84–91 | 175 | 254 |
| Blowing Time (min.) | 189 | 111 | 60–80 |
| Agitation Time (min.) | 73 | 69 | |
| Material Transfer (min.) | 60 | 60 | 40–60 |

These results exclude the test which used sole operation of the east lance. Total cycle time for lance type operation was greatly increased due to the experimental nature of the tests. Cycle times estimated for commercial operation, assuming a 181 standard metric tons per day top blown oxygen supply, is set forth in Table 5 compared to typical tuyere type operation.

TABLE 5

| | Lance | Tuyere |
|---|---|---|
| Material Handling | 60 min. | 40–60 min |
| Top Blowing | 108 min. | 60–80 min |
| Agitation/Cooling | 60 min. | |
| Total | 228 min. | 180–210 min |

The method of this invention is roughly equivalent to the tuyere method for length of cycle time. However, the method of the invention decreases final sulfur content and reduces maintenance costs. Furthermore, excess heat capacity provides for melting of copper scrap without addition of costly fuel and without the requirement for a separate remelt furnace or separate holding facility.

While in accordance with the provisions of the statute, there is illustrated and described herein specific embodiments of the invention. Those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A converter for purifying nonferrous materials by top blowing a gas containing oxygen in combination with bottom sparging comprising:

a converter body for smelting a molten nonferrous material, said converter body having a refractory lined chamber, said chamber having a lower portion for holding said nonferrous material and an upper portion above said lower portion, a gas injector means piercing said lower portion for bottom sparging said nonferrous material with a gas selected from a group consisting of inert gases and reducing gases, and a lance piercing said upper portion of said converter body in a location distally spaced from a highest temperature region of said converter during smelting, said location having a temperature at least 25% cooler during smelting than temperature of said nonferrous material in degrees Kelvin when a supplemental burner is not being operated, said lance being connectable to an oxidizing gas supply for directing oxidizing gas to bottom sparged nonferrous material and oxidizing at least one impurity from the nonferrous material, said lance projecting minimally into said chamber for limiting exposure of said lance to adverse conditions within said upper portion of said converter body.

2. The converter of claim 1 wherein said lance is also connectable to a gaseous fuel supply for heating the nonferrous material.

3. The converter of claim 1 wherein said lance is downwardly sloped and projects less than 1 m into said upper portion.

4. The converter of claim 1 wherein said converter body has an end wall and said lance pierces an upper portion of said end wall.

5. The converter of claim 1 wherein said lance is connected to a low pressure oxygen supply.

6. The converter of claim 1 wherein the converter is a modified Peirce-Smith converter which does not require tuyeres.

7. The converter of claim 1 wherein porous plugs in said lower portion of said converter body supply the sparging gas to said nonferrous material for bottom stirring.

8. The converter of claim 7 wherein said porour plugs are located in positions laterally spaced from converter operating mechanisms below said lower portion of said converter body.

9. The converter of claim 7 wherein said porous plugs are rotatable above said molten nonferrous material without emptying said converter body.

10. The converter of claim 1 wherein said converter has an efficiency of oxygen use in oxidizing nonferrous sulfides of greater than 75%.

11. A method of purifying molten nonferrous materials comprising:

a) introducing a molten nonferrous material into a converter, said molten nonferrous material having a top surface and said converter having a lower portion filled with said molten nonferrous material below said top surface, b) sparging said molten nonferrous material from said lower portion of said converter with a gas selected from the group consisting of inert gases and reducing gases to circulate said molten nonferrous material to said top surface of said converter and remove solid oxidized product from areas of said top surface of said molten nonferrous material, and c) blowing said exposed top surface of said nonferrous material with a gas from a lance minimally exposed to said top surface containing oxygen to remove at least one impurity by oxidation from the nonferrous material to form a purified molten nonferrous metal said oxygen being directed from a location distally spaced from a highest temperature region of said converter during smelting, said location having a temperature at least 25% cooler during smelting during smelting than the temperature of said nonferrous material in degrees Kelvin when a supplemental burner is not being used.

12. The method of claim 11 including the additional step of:

d) adding solid nonferrous metal to said converter to cool said molten nonferrous material and purified molten nonferrous metal.

13. The method of claim 11 wherein said converter is bottom sparged with substantially pure nitrogen and top blown with substantially pure oxygen.

14. The method of claim 11 wherein said lance extends less than 1 m into said converter.

15. The method of claim 12 wherein copper metal is cooled with scrap metal to a temperature below about 1200° C. after blowing and prior to bottom sparging in the absence of blowing.

16. The method of claim 11 including the additional step of burning fuel to maintain temperature within said converter.

17. The method of claim 11 wherein said molten nonferrous material is a nonferrous sulfide and said at least one impurity includes sulfur.

18. The method of claim 11 wherein said sparging comprises introducing inert gas through porous plugs which are rotatable above said molten nonferrous material without emptying said converter.

* * * * *